US010563953B2

(12) United States Patent
Tedder et al.

(10) Patent No.: US 10,563,953 B2
(45) Date of Patent: Feb. 18, 2020

(54) RETENTION DEVICE

(71) Applicant: Tedder Industries, LLC, Post Falls, ID (US)

(72) Inventors: Thomas Tedder, Post Falls, ID (US); Timothy Treto, Mead, WA (US); Jacob Shearer, Post Falls, ID (US); Silas Van Natter, Post Falls, ID (US)

( * ) Notice: Subject to any disclaimer, the term of this patent is extended or adjusted under 35 U.S.C. 154(b) by 75 days.

(21) Appl. No.: 15/874,731

(22) Filed: Jan. 18, 2018

(65) Prior Publication Data

US 2018/0202763 A1 Jul. 19, 2018

Related U.S. Application Data

(60) Provisional application No. 62/447,757, filed on Jan. 18, 2017.

(51) Int. Cl.
*F41C 33/02* (2006.01)

(52) U.S. Cl.
CPC ..... *F41C 33/0263* (2013.01); *F41C 33/0236* (2013.01)

(58) Field of Classification Search
CPC .... F41C 33/041; F41C 33/001; F41C 33/008; F41C 33/0236; F41C 33/0254; F41C 33/0272; A45F 2200/0591; Y10S 224/912
See application file for complete search history.

(56) References Cited

U.S. PATENT DOCUMENTS 5,421,497 A * 6/1995 Gilmore ..... A45F 5/00 224/192
5,630,535 A * 5/1997 Valenti ..... A45F 5/02 224/191
7,258,259 B1 * 8/2007 Owens ..... A45F 5/02 224/192
8,474,670 B1 * 7/2013 Gregory ..... F41C 33/0263 224/243
10,302,391 B1 * 5/2019 Akar ..... F41C 33/0263
2006/0065689 A1 * 3/2006 Johnson ..... A45F 5/02 224/675
2013/0181021 A1 * 7/2013 Yarbrough ..... F41C 33/0236 224/244
2013/0299543 A1 * 11/2013 Rorick ..... F41C 33/0263 224/674
2014/0061262 A1 * 3/2014 Pomeroy ..... F41C 33/0209 224/243
2014/0109345 A1 * 4/2014 Melville ..... F41C 33/041 24/3.1
2014/0158733 A1 * 6/2014 McDonnell ..... B60R 7/14 224/587
2015/0034684 A1 * 2/2015 Tedder ..... A45F 5/00 224/242
2015/0345898 A1 * 12/2015 Bardy ..... F41C 33/0263 224/244
2015/0345899 A1 * 12/2015 Bardy ..... F41C 33/0236 224/243

(Continued)

*Primary Examiner* — Brian D Nash
(74) *Attorney, Agent, or Firm* — Timberline Patent

(57) ABSTRACT

Representative implementations of devices and techniques provide an adjustable retention system for an implement holster (such as a handgun holster, for example). The retention device of the adjustable retention system can be temporarily or permanently coupled to a holster, and includes at least one retention bump protruding from a surface of a base of the device.

19 Claims, 11 Drawing Sheets

(56) References Cited

U.S. PATENT DOCUMENTS

| | | | | |
|---|---|---|---|---|
| 2016/0040957 | A1* | 2/2016 | Finsand | F41C 33/008 224/269 |
| 2016/0216065 | A1* | 7/2016 | Tedder | F41C 33/0263 |
| 2016/0238342 | A1* | 8/2016 | Tedder | F41C 33/0263 |
| 2016/0273878 | A1* | 9/2016 | Sereday | F41C 33/0209 |
| 2017/0010066 | A1* | 1/2017 | Miller | B29C 61/02 |
| 2017/0089666 | A1* | 3/2017 | Considine | F41C 33/048 |
| 2017/0099934 | A1* | 4/2017 | Evans | F42B 39/02 |
| 2017/0115095 | A1* | 4/2017 | Moultrie | F41C 33/041 |
| 2017/0122702 | A1* | 5/2017 | Liang | F41C 33/0272 |
| 2017/0184376 | A1* | 6/2017 | Porat | F41G 11/003 |
| 2017/0191794 | A1* | 7/2017 | Garibaldi | F41C 33/0236 |
| 2017/0205189 | A1* | 7/2017 | Rogers | F41A 19/11 |
| 2017/0276453 | A1* | 9/2017 | Lance | F41C 33/0254 |
| 2017/0292809 | A1* | 10/2017 | Romano | A45F 5/021 |
| 2018/0010883 | A1* | 1/2018 | Tedder | B60R 7/14 |
| 2018/0106576 | A1* | 4/2018 | Tedder | F41C 33/0263 |
| 2018/0140058 | A1* | 5/2018 | Tedder | F41C 33/0263 |
| 2018/0142988 | A1* | 5/2018 | Tedder | F41C 33/0236 |
| 2018/0142989 | A1* | 5/2018 | Tedder | F41C 33/041 |
| 2018/0149447 | A1* | 5/2018 | Waters | F41C 33/045 |
| 2018/0164072 | A1* | 6/2018 | McKendrick | F41C 33/0209 |
| 2018/0195834 | A1* | 7/2018 | Tedder | A45F 5/02 |
| 2018/0202763 | A1* | 7/2018 | Tedder | F41C 33/0263 |
| 2019/0178609 | A1* | 6/2019 | Horlacher | F41C 33/0209 |

* cited by examiner

RETENTION DEVICE

PRIORITY CLAIM AND CROSS-REFERENCE TO RELATED APPLICATION

This application claims the benefit under 35 U.S.C. § 119(e)(1) of U.S. Provisional Application No. 62/447,757, filed Jan. 18, 2017, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

A holster should reliably retain the handgun until it is to be used, but allow the user to draw the handgun for use without undue effort or difficulty. It may be desirable to adjust the retention of a holster, to accommodate the user's preference and intended type of use. In some cases, adjusting the retention of holsters, and particularly adjusting the retention of hard shell holsters can be problematic.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
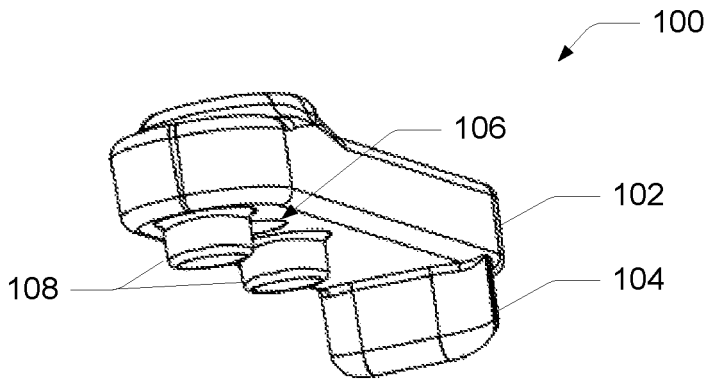
FIG. 1 shows a perspective view of an example retention device, according to an implementation.

An implement holster (such as a handgun holster, etc.) may have a recessed area on one or both sides of the holster that protrudes into the cavity of the holster at the trigger guard location. When an implement is holstered or drawn, this recessed area can interfere with a portion of the implement, such as the trigger guard, causing the sides of the holster to flex outward as the implement passes by the recessed area. The holster's resistance to flexing creates retention. The interference, ramping, and flexing of the holster is a form of passive retention. Some forms of passive retention rely on friction alone or on a combination with ramping that increases friction.

Other forms of holster retention may include mechanisms for user-operation, such as having a retention mechanism that is built into or onto the holster. Removing the implement from the holster includes operating the mechanisms in addition to simply pulling the implement out of the holster. Such mechanisms can include buttons, levers, hoods, and straps, known as active retention elements.

Passive retention techniques can sometimes be preferred due to their simplicity of operation. In some cases, a holster can be designed to have adjustable passive retention. For example, a screw-adjustable spring element can be provided at the recessed area (for instance) that pushes (or pulls) on the side walls of the holster, controlling how tight the two sides of the holster grip the pistol. The screw may include a Philips or Allen head (or other) for user adjustment. Tightening the spring element increases the tension of the holster walls, and thus the retention of the holster. However, with some holster designs, such as rigid holster shells, the walls of the holster are less flexible, rendering such techniques less effective. Further, some holster shells are comprised of multiple interlocking shell portions, which can also restrict the ability of the holster walls to flex.

Representative implementations of devices and techniques herein disclosed provide an adjustable retention system for an implement holster (such as a handgun holster, for example). In various implementations, the retention devices of the adjustable retention system can be temporarily or permanently coupled to a holster, or they can be integral to the holster. The adjustable retention system is adjustable to various retention levels (tension strengths) by a user in the field, based on the easy to use retention devices, which are secure enough to use with a handgun holster.

In various embodiments, a retention device of the adjustable retention system includes at least one retention bump protruding from a base of the device. When the base is mounted to a holster, the retention bump is inserted into an opening in the holster, protruding into the holster cavity. The retention bump contacts a portion of the implement (such as a trigger guard, for example) when the implement is holstered and when the implement is withdrawn from the holster. The retention bump resists the movement of the implement within the holster, engaging the implement, particularly resisting the withdrawal of the implement from the holster to retain the implement within the holster.

When the implement passes by the retention bump on its way into or out of the holster, it causes the retention device to flex outward, pushing the retention bump out of the holster cavity, to make room for the implement to pass through the holster cavity. The amount of force needed to overcome the resistance of the retention device in withdrawing the implement from the holster defines the retention value of the retention device and defines at least a portion of the retention value of the holster. The retention value of the retention device is determined mostly by the length of the retention bump (i.e., how far the retention bump extends into the holster cavity), the flexibility (or retractability) of the retention bump, and the flexibility of the base. The flexibility of the base can be a result of the length of the base from a mounting point to the retention bump, a width of the base, a thickness of the base (or a thickness of the material of the base), and the properties of the material of the base.

In an implementation, the retention system includes a plurality of retention devices, each with a different retention value. The retention devices may be interchangeably coupled to an implement holster (or the like) for determining and adjusting the retention of the holster. For example, to increase the retention of the holster, the retention device mounted to the holster can be user-exchanged for one having a greater retention value. The quantity of retention devices with different retention values determines the adjustability of the retention of the holster.

In another implementation, an adjustable retention system includes one retention device. The retention device has a retention bump that is extendable or retractable by a user to adjust a retention of the retention device. In alternate embodiments, multiple retention devices with adjustable retention bumps may be included in the adjustable retention system, where each of the devices provides a retention range, for example.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the adjustable retention system components illustrated in the figures may vary to accommodate various applications. In alternate embodiments, fewer, additional, or alternate components may be used and/or combined to form an adjustable retention system or a retention device having an equivalent function and operation.

Implementations are explained in more detail below using a plurality of examples. Although various implementations and examples are discussed here and below, further implementations and examples may be possible by combining the features and elements of individual implementations and examples.

Example Adjustable Retention System

Figure 2:
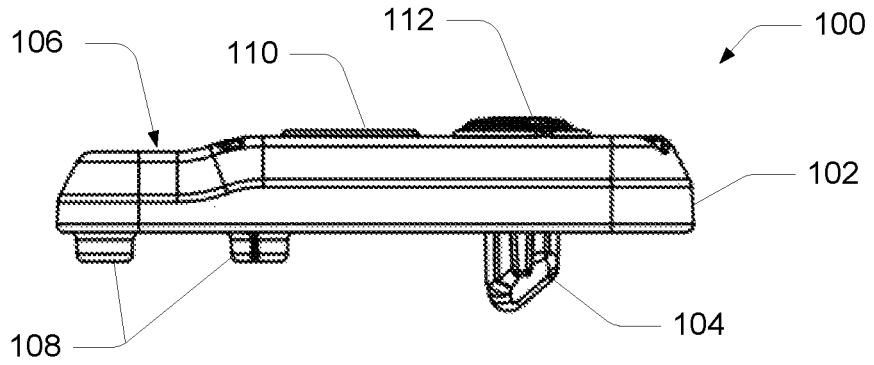
FIG. 2 shows a side profile view of an example retention device, according to another implementation.

Example retention devices 100, of an example adjustable retention system 300 are shown in FIGS. 1 and 2. In an implementation, a retention device ("device") 100 may be removably coupled to a carrier 502 (see FIGS. 5 and 6) to form an adjustable retention holster 500, for example. In some implementations, multiple devices 100 are coupled to a carrier 502 to form an adjustable retention holster 500.

As shown in FIGS. 1 and 2, in various embodiments, a device 100 includes a base 102 and at least one retention bump 104. The retention bump 104 extends from a surface of the base 102, and has various physical characteristics (length, width, depth, protrusion angle, taper, surface friction, etc.) which all combine to determine a retention of the bump 104. The length of the bump 104 can be a significant factor of the retention of the device 100, since the length of the bump 104 determines the extent to which the bump 104 protrudes into the cavity of the carrier 502. The retention of the device 100 is thus based on the retention of the bump 104 as well as on the physical characteristics of the base 102, including length of the base 102 from a mounting point 106 to the retention bump 104, a width of the base 102, a thickness of the base 102 (or a thickness of the material of the base 102), and the properties of the material of the base 102.

In the embodiments, as shown in FIGS. 1 and 2, the device 100 includes attachment components, such as one or more mounting points 106 and one or more alignment nubs 108. The alignment nubs 108 allow the retention device 100 to be aligned to the carrier 502 for proper operation and secure mounting to the carrier 502. Temporary fasteners (e.g., screws, bolts, etc.) may be used at the mounting point(s) 106 to removably couple the device 100 to the carrier 502. Alternately, permanent fasteners (e.g., rivets, security screws, adhesive, etc.) can be used at the mounting point(s) 106 to permanently couple the retention device 100 to the carrier 502, if desired.

Figure 3:
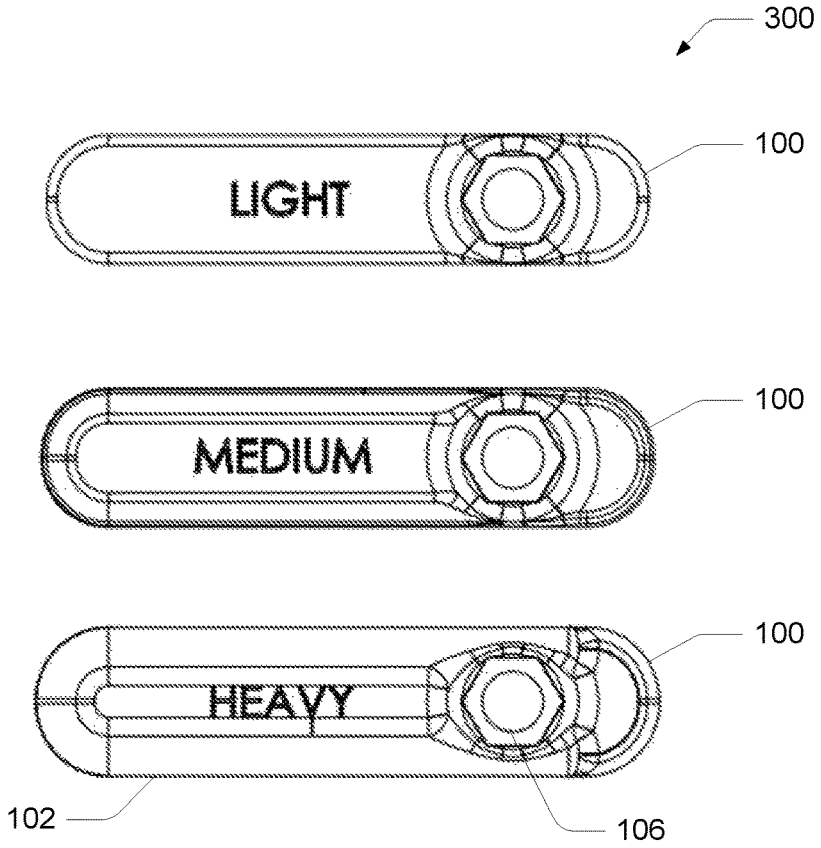
FIGS. 3 and 4 show two views (top and profile, respectively) of example retention devices of varying tensions, according to an embodiment.
Figure 4:
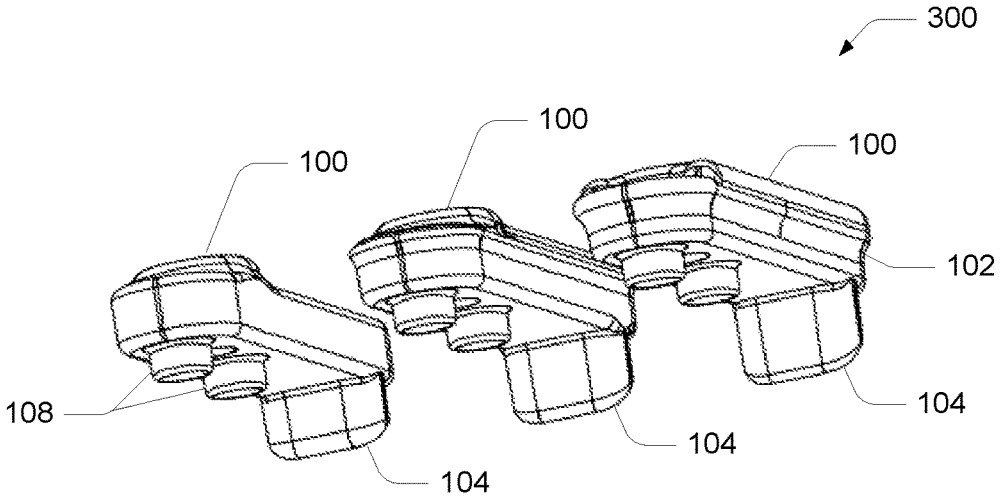

Referring to FIGS. 3 and 4, in an implementation, an example adjustable retention system 300 can include multiple retention devices 100, each with a different retention value. For example, the retention devices 100 of the system 300 can have retention values that range from "light" to "medium" to "heavy" retention. In alternate embodiments, an adjustable retention system 300 can have any number of retention devices 100 with varying levels of retention.

For example, although three example tension levels (Heavy, Medium, and Light) are illustrated in FIGS. 3 and 4, retention devices 100 can be produced to achieve more than three levels of passive retention, based on materials or combinations of materials used to form the devices 100, the shape and dimensions of the base 102, the shape and dimensions of the retention bump 104, the surface friction of the bump 104, and the like. In various embodiments, the retention devices 100 can be comprised of metals, alloys, composites, polymers, fiberglass, carbon fiber, laminates, natural or synthetic rubbers, and the like, including combinations or layers of more than one material.

Figure 5:
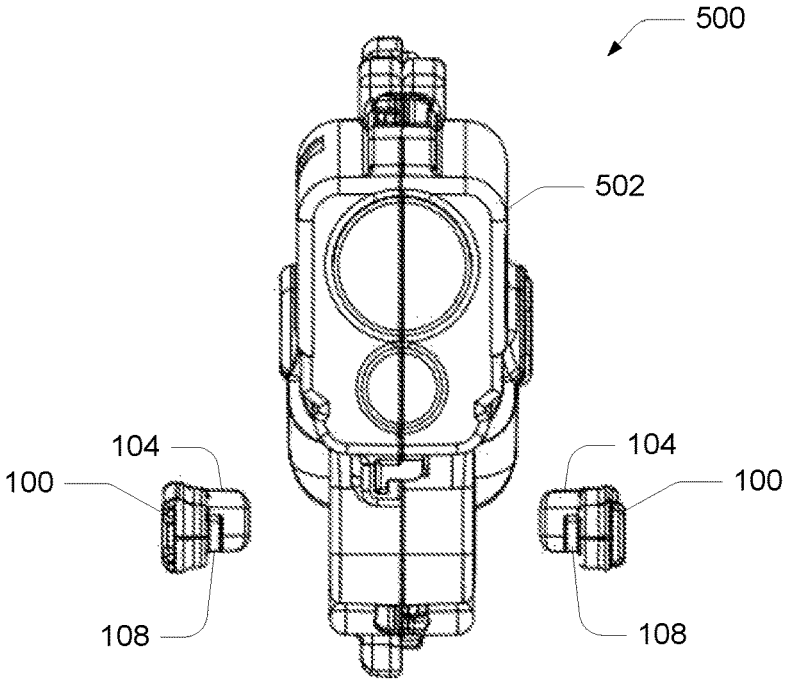
FIGS. 5 and 6 show a front view of an example installation of retention devices on a holster, according to an implementation.
Figure 6:
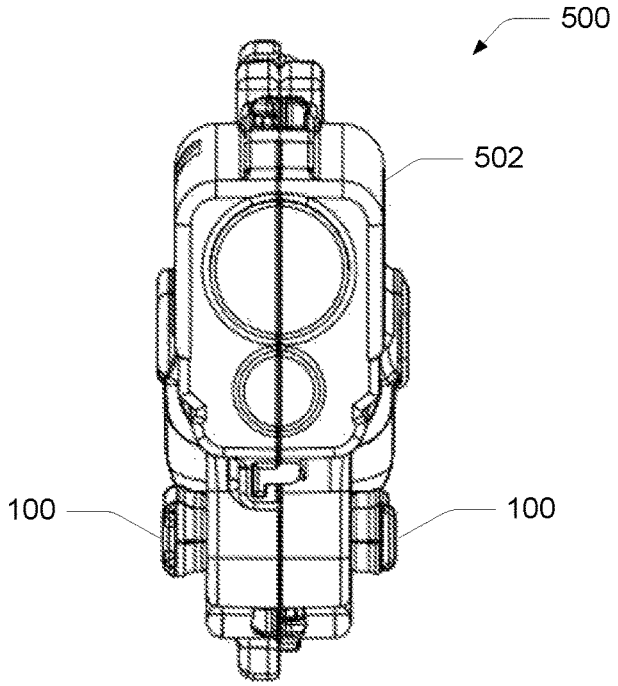

Referring to FIGS. 5 and 6, one or more retention devices 100 can be installed on a carrier 502, to determine a retention of the carrier 502. In an implementation, a carrier 502 with one or more retention devices 100 comprises an adjustable retention holster 500. In various embodiments, the retention device(s) 100 are installed on the carrier 502 so that they will interact and engage with at least a portion of the implement (such as a trigger guard, or another portion of the implement body, for example) as the implement is holstered and/or withdrawn from the carrier 502. In one embodiment, the carrier 502 includes openings on one or more sides of the carrier 502, providing access to the inside of the carrier 502 (e.g., the cavity 702 of the carrier 502, see FIG. 7, for example). The retention bump 104 of the device 100 is inserted into the opening and protrudes into the cavity 702 when installed on the carrier 502.

Figure 9:
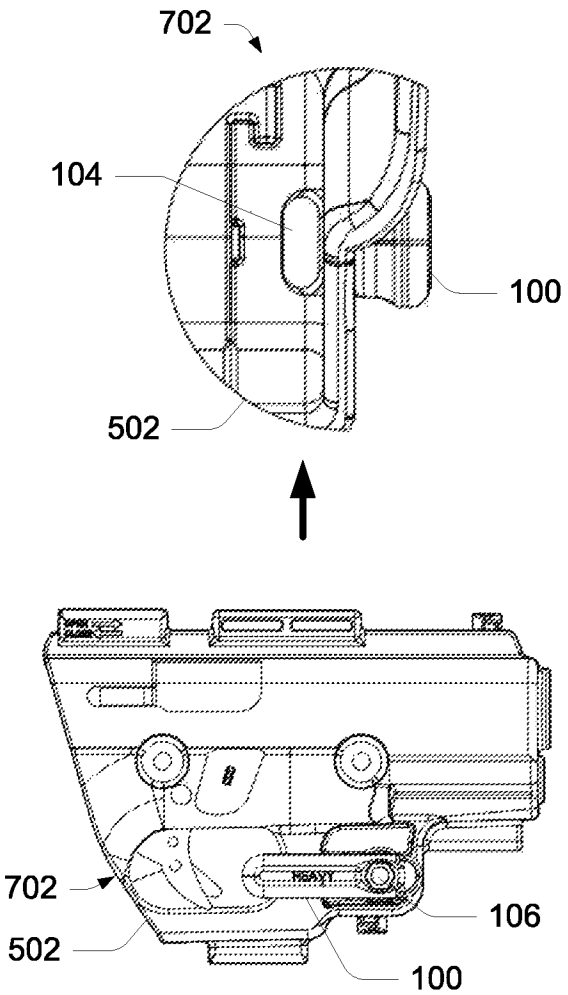
FIGS. 7-9 show side views of example retention devices installed on a holster, with corresponding detail of retention bumps, according to an implementation.
Figure 8:
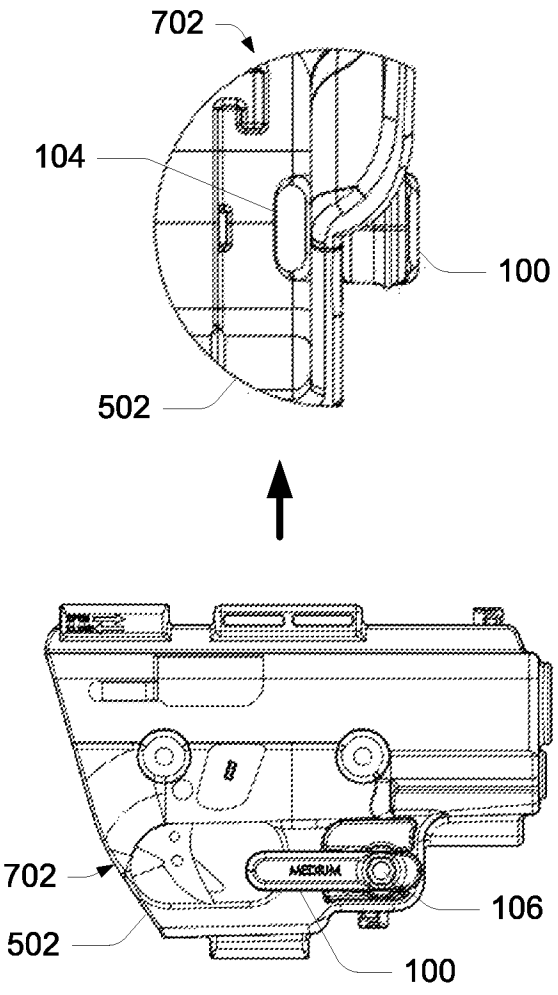
Figure 7:
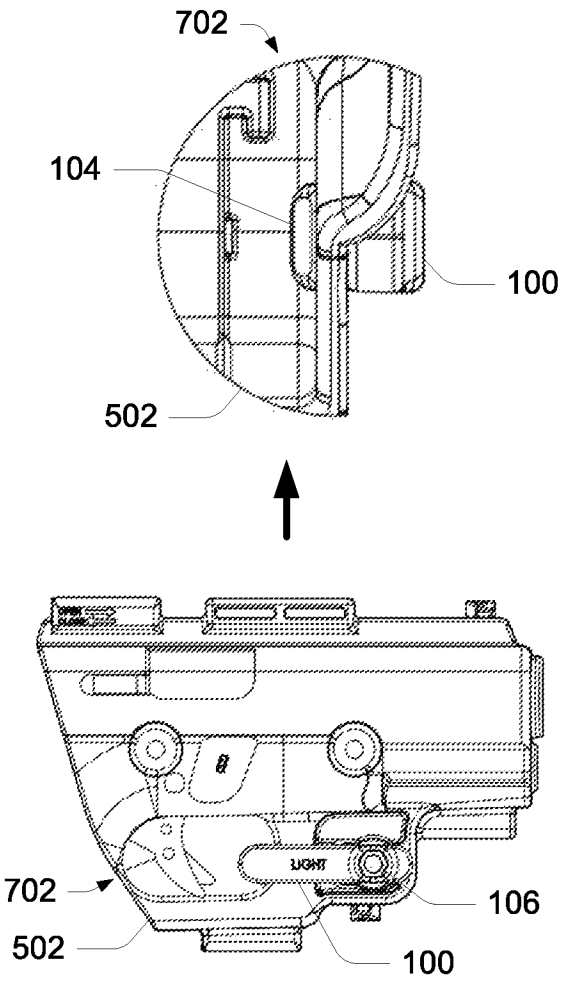
Figure 10:
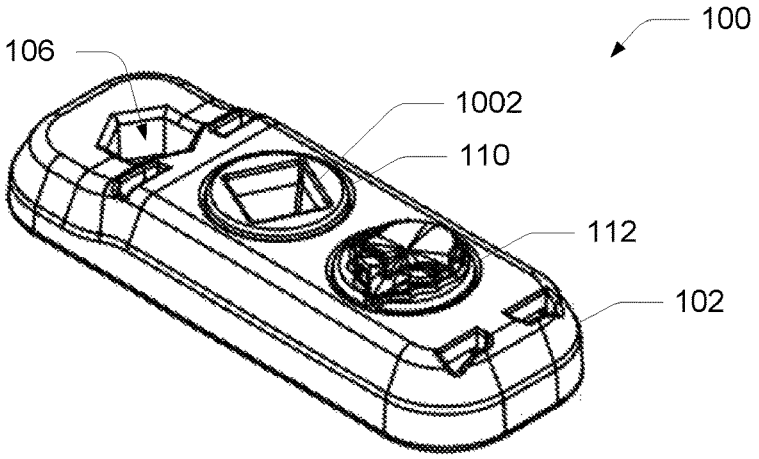
FIGS. 10-16 show several views of an example retention device, according to an implementation.
Figure 11:
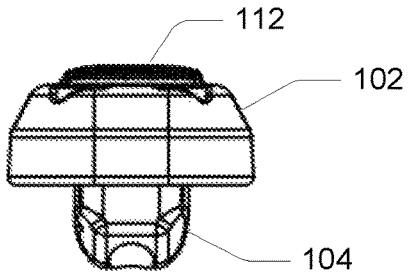
Figure 12:
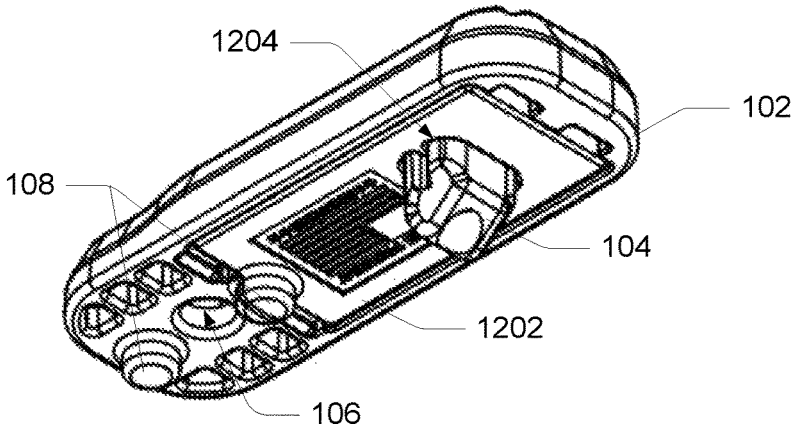
Figure 13:
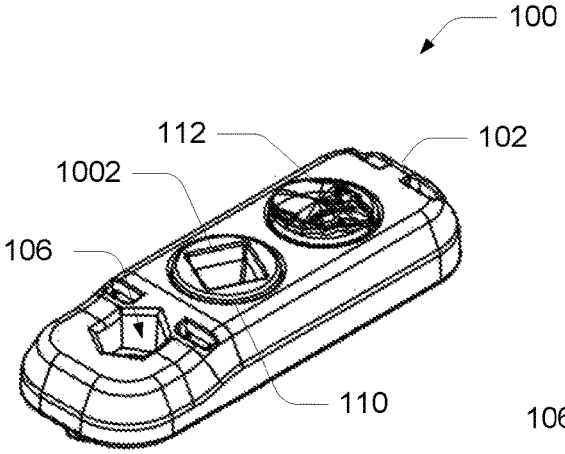
Figure 14:
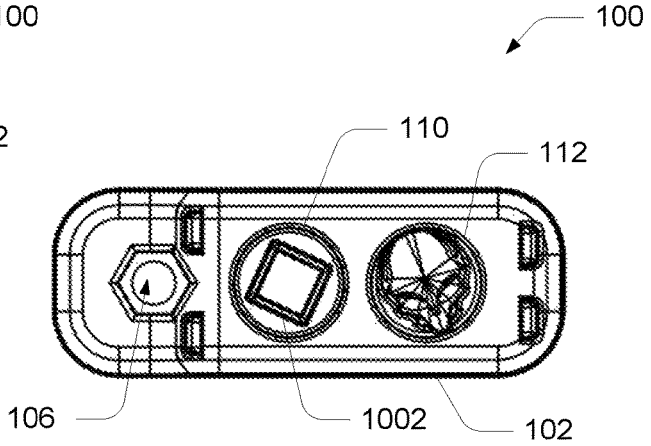
Figure 15:
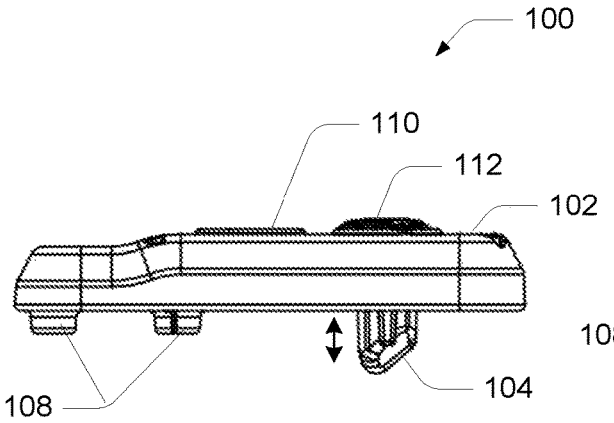
Figure 16:
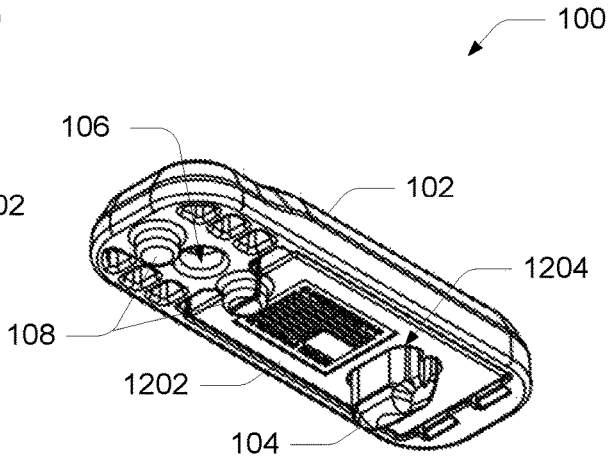

Referring to FIGS. 7-9, in various embodiments, the retention device 100 can be coupled to the carrier 502 at a single end (at the "mounting point 106") of the retention device 100, using a screw, a bolt, or any other temporary (or permanent if desired) fastener. In some cases, the retention device 100 may include an integrated (molded in or coupled) temporary or permanent fastener, such as a clip, snap, or the like. Attachment of the retention device 100 at one end of the device 100 allows the device 100 to flex when the implement pushes on the bump 104 at the other end of the device 100 while being holstered or withdrawn. In the embodiments, the bump 104 is disposed at an opposite end (or some preselected distance) from the mounting point 106, to allow the base 102 to flex. The alignment nubs 108 may be disposed into recesses, openings, or other features of the carrier 502 to maintain the position of the retention device 100 with respect to the carrier 502 while coupled to the carrier 502.

As shown in FIGS. 7-9, the retention device 100 can be positioned to overlap the trigger guard portion of a carrier 502, such as a holster. The carrier 502 may have an opening at the trigger guard portion, and the retention bump 104 of the retention device 100 may protrude into the cavity 702 of the carrier 502 through the opening. Each of FIGS. 7-9 show a side view of the adjustable holster 500 and includes a view inside the holster 502, looking into the cavity 702 from where the implement is inserted into the holster 502. As illustrated in FIGS. 7-9, the retention bump 104 is shown protruding into the cavity 702 of the holster 502 a different amount, based on the length of the bump 104. FIG. 7 shows a "light" retention device 100, with a retention bump 104 protruding a first distance into the cavity 702. FIG. 8 shows a "medium" retention device 100, with a retention bump 104 protruding a second distance, greater than the first distance, into the cavity 702. FIG. 9 shows a "heavy" retention device 100, with a retention bump 104 protruding a third distance, greater than the second distance, into the cavity 702.

The retention bump 104 can trap the trigger guard of the implement (e.g., handgun) while the implement is holstered. As shown in FIGS. 1, 2, 4, 12, 15, 16-19, and 21-23, in an embodiment, the retention bump 104 is shaped with a "ramped" shape on the leading edge of the bump 104 to allow the trigger guard to pass by the bump 104 somewhat easily when inserting the handgun into the carrier 502. In an implementation, the retention bump 104 is shaped with a "blocked" shape on the trailing edge of the bump 104 to apply more resistance to the trigger guard when the handgun is removed. In alternate embodiments, the retention bump 104 may have other shapes to accommodate insertion and removal retention. During either action, the retention device 100 is arranged to flex outward, moving out of the cavity 702 when the trigger guard (or other portion of the implement) passes by the retention bump 104. The amount of resistance to the outward flexing determines the retention level of the retention device 100.

In various embodiments, the base 102 of the retention device 100 determines the flexibility/rigidity and thus the tension level of the retention device 100. While the retention device 100 is coupled to the carrier 502, the resistance of the base 102 to flexing or bending when the implement is removed from the carrier 502 determines the retention level of the retention device 100. Accordingly, retention devices 100 can be made available with various materials and thicknesses (and lengths) to produce varying flexibility, and thus tension levels of the bases 102 of the retention devices 100. In some embodiments, the base 102 of the retention device 100 may be tapered in width and/or thickness to determine the tension level of the retention device 100.

In various embodiments, the one or more retention devices 100 may be installed, removed, or interchanged by a user as desired to adjust the retention of the carrier 502. For example, to increase the retention of the carrier 502, a retention device 100 mounted to the carrier 502 can be user-exchanged for one having a greater retention value. The quantity of retention devices 100 with different retention values determines the adjustability of the retention of the carrier 502 or the adjustable retention holster 500.

A user can use any combination of retention devices 100 to achieve the desired tension levels for the carrier 502. In various embodiments, a single retention device 100 may be used with a carrier 502, or two or more retention devices may be used (as shown in FIGS. 5-9). For example, the user can use a combination of retention devices (on either side of the carrier 502, for instance) having tension levels comprising Light and Hard; Medium and Hard; Medium and Light; just one Light; just one Medium; etc. (or other combinations with other retention levels, e.g., medium-hard, medium-light, extra-light, etc.). In this way, the user can determine how easily or how much force is needed to remove the implement from the carrier 502, or adjust the retention of a carrier 502 for a different implement or application.

Referring to FIGS. 10-28, in various embodiments, a retention device 100 can have adjustable levels of retention. Accordingly, an adjustable retention system 300 can include one or two retention devices 100 that are adjustable. For example, a retention device 100 may be adjustable by adding or removing layers of varying materials to the base 102, or the like.

In an implementation, as shown in FIGS. 10-23, a retention device 100 can include one or more moveable parts to adjust a retention of the device 100. For example, the retention device 100 can include a retention bump 104 that is configured to move relative to the base 102. In an embodiment, the base 102 includes one or more adjustment screws 110, which when rotated, cause the bump 104 to retract or extend from the base 102. For instance, rotating the adjustment screw 110 a first direction retracts the bump 104 and rotating the screw 110 a second direction extends the bump 104 from the base 102. In the embodiment, retracting the bump 104 reduces the retention of the device 100 and extending the bump 104 increases the retention of the device 100.

In an embodiment, as shown in FIGS. 10-18, the at least one adjustment screw 110 is exposed through the surface of the base 102 to access the screw 110. The adjustment screw 110 includes a feature 1002, such as a shaped recess for example, that allows a key (1902, for example) or tool to engage the adjustment screw 110 at the feature 1002 to rotate the screw 110. Without the key or tool, the adjustment screw 110 is difficult to rotate, making unintentional rotations of the screw 110, and unintentional retention adjustments difficult and unlikely.

In an embodiment, as shown in FIGS. 10-18, the retention device 110 includes a gear-drive to move the retention bump 104. The adjustment screw 110 comprises a mechanical gear (having teeth, splines, grooves, helix, etc.), which engages another mechanical gear, an adjustment gear 112. In some embodiments, most of the adjustment screw 110 and the adjustment gear 112 are disposed within the base 102 of the retention device 100, which may be partially or fully hollow.

In alternate embodiments, more or less of the adjustment screw 110 and the adjustment gear 112 are exposed outside the base 102, or are coupled to an outer surface of the base 102.

In an embodiment, the retention bump 104 is moveably coupled to the adjustment gear 112 via a screw device 1802, or the like, and is moveably coupled to the base cover 1202, by extending and retracting though an opening 1204 in the base cover 1202. In various examples, the opening 1204 in the base cover 1202 is featured, having a shape to fit closely around the retention bump 104 to guide the bump 104 as it travels. The opening 1204 may also have a featured shape, such as a tab, or the like, to match a groove (or the like) on the bump 104, to assist in guiding and keeping the retention bump 104 aligned.

The screw device 1802 is fixed to the lower portion of the adjustment gear 112, so that when the adjustment gear 112 turns, the screw device 1802 turns as well. The retention bump 104 includes a screw hole 1702 (see FIG. 23) in the top of the bump 104, which the screw 1802 is threaded into. The bump 104 is restricted from turning when the screw device 1802 turns, due to the perimeter shape of the bump 104 and the matching opening 1204 in the base cover 1202. Accordingly, when the adjustment screw 110 is rotated, the adjustment gear 112 rotates in an opposite direction, which rotates the screw device 1802 fixed to the adjustment gear 112, causing the retention bump 104 to either retract or extend (based on the direction of rotation of the screw device 1802) as the screw device 1802 threads or unthreads in the screw hole 1702 of the retention bump 104 (see, for example, the cutaway illustrations of FIGS. 22, 23, and 27).

Figure 17:
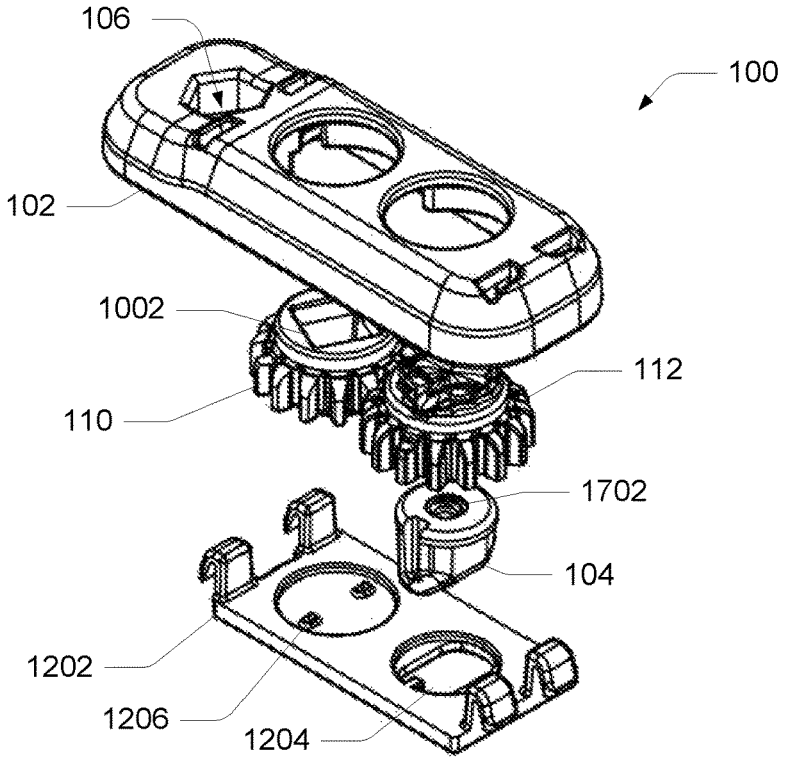
FIGS. 17 and 18 show exploded views of an example retention device, according to an implementation.
Figure 18:
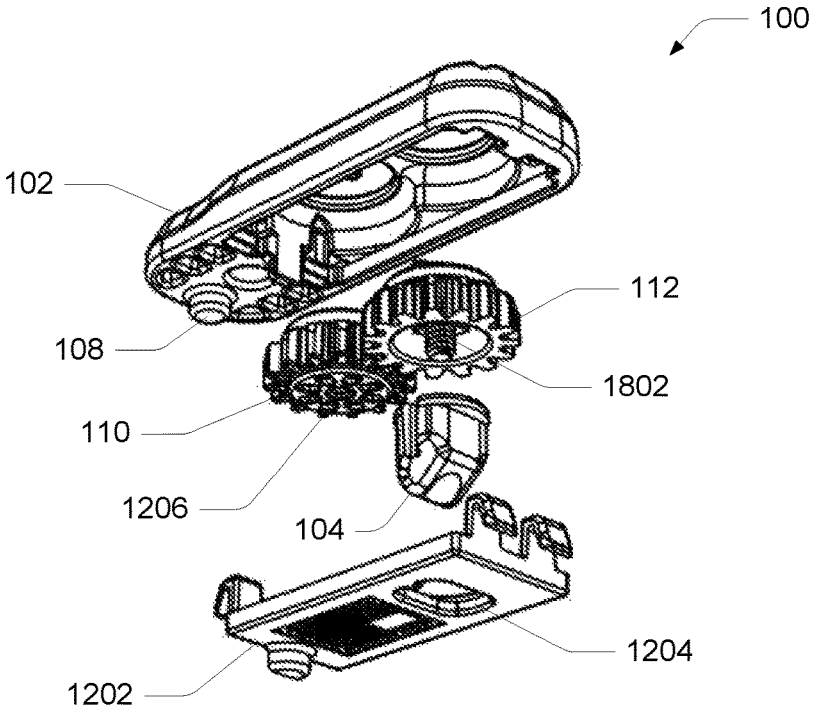
Figure 19:
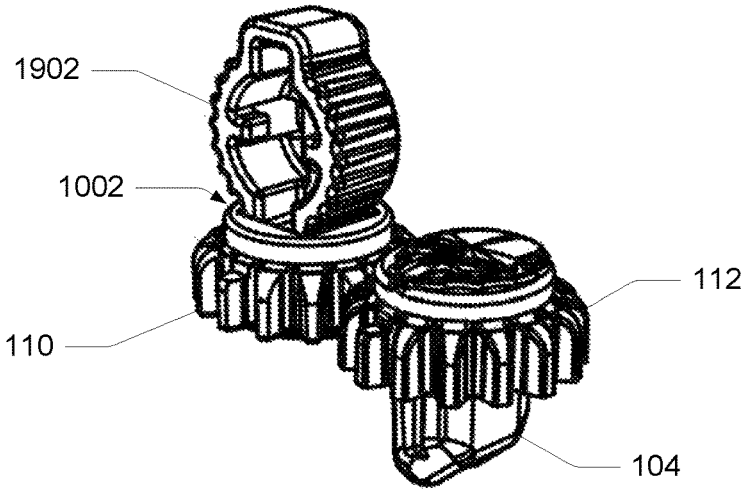
FIGS. 19-23 show several views of example retention device components, according to an implementation.
Figure 20:
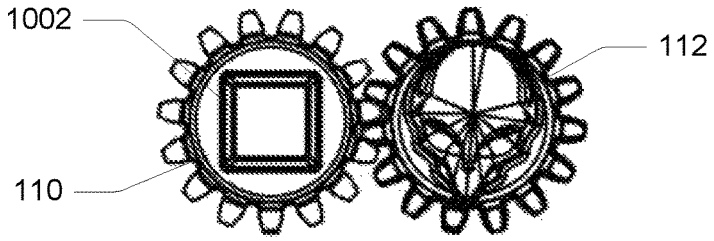
Figure 21:
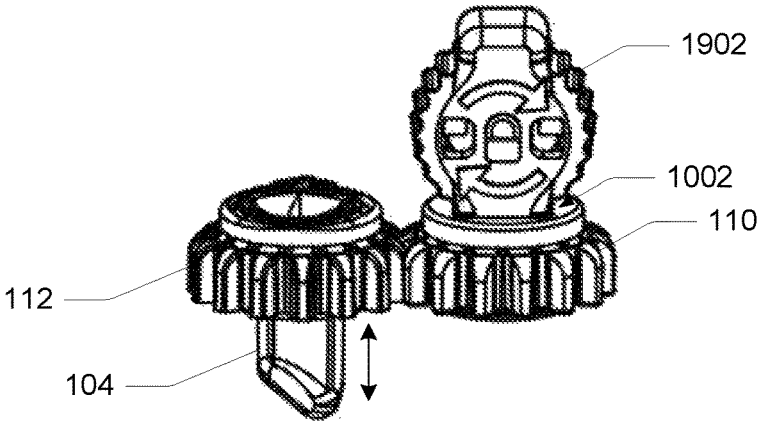
Figure 22:
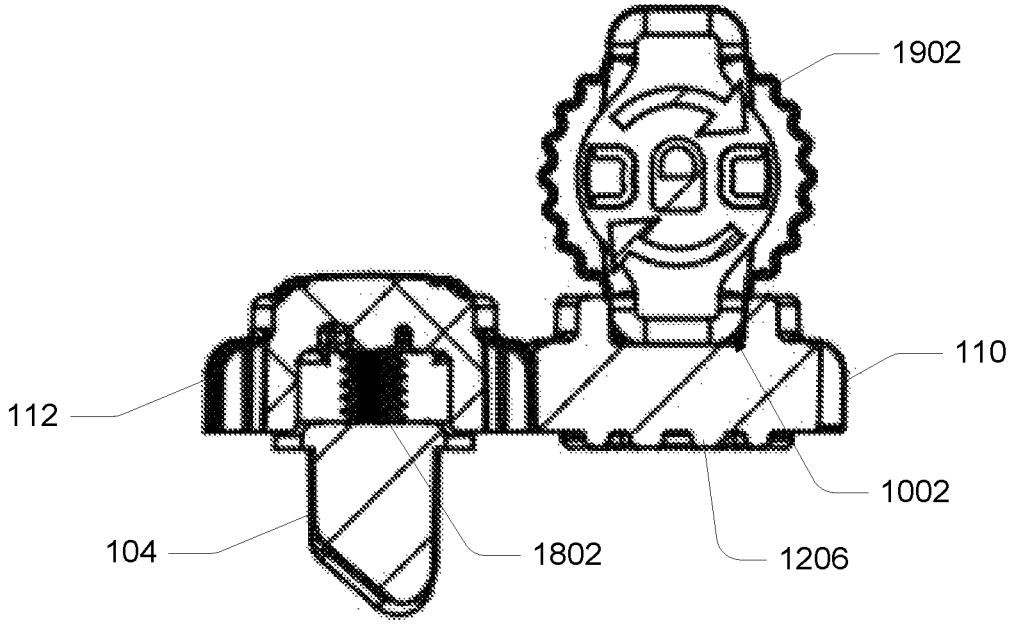
Figure 23:
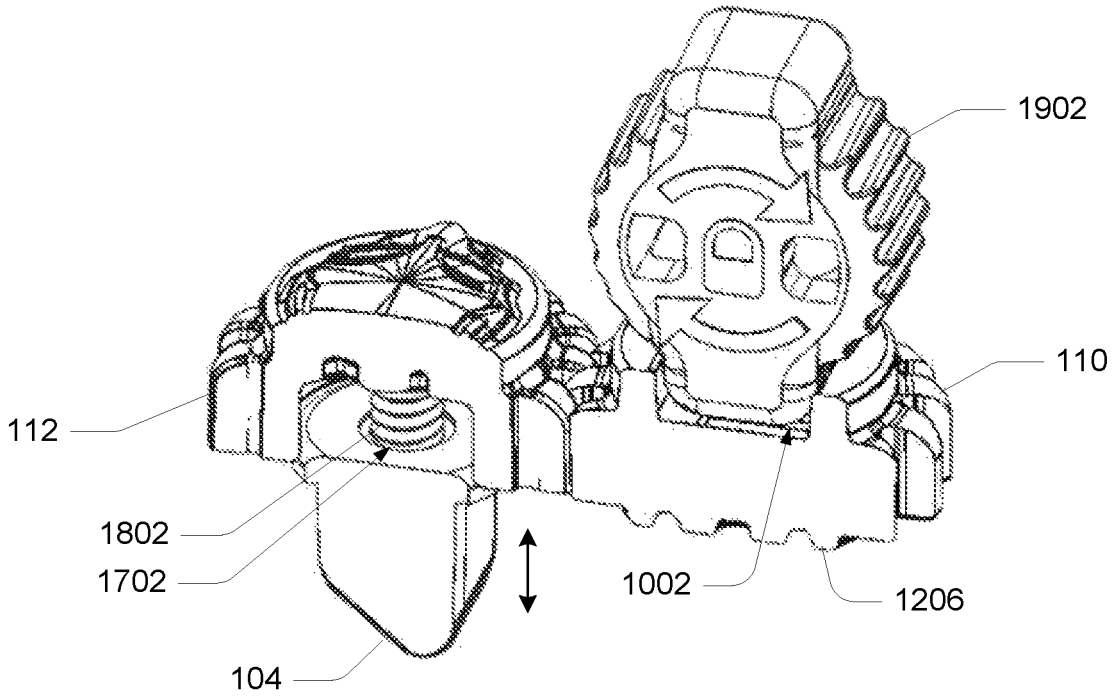

In various examples, as shown in FIGS. 17 and 18, stop features 1206 (or "click" features), such as tabs, grooves, detents, or the like, may be included on the inside surface of the base cover 1202, the bottom of the adjustment screw 110, or both, to give feedback to the user when rotating the adjustment screw 110 and to define discrete retention adjustment intervals.

Figure 24:
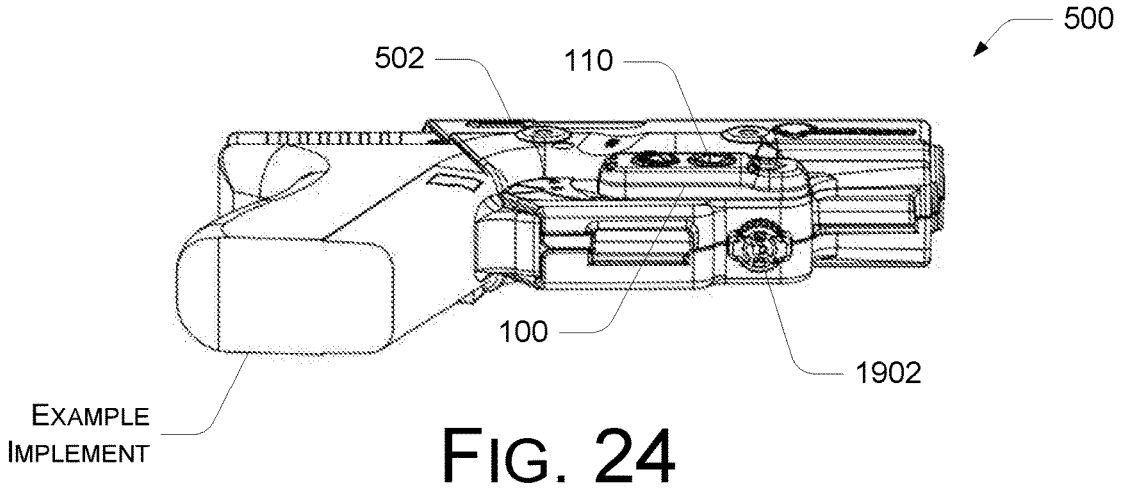
FIGS. 24-28 show sequential views of an example technique for adjusting a retention device, according to an implementation.
Figure 25:
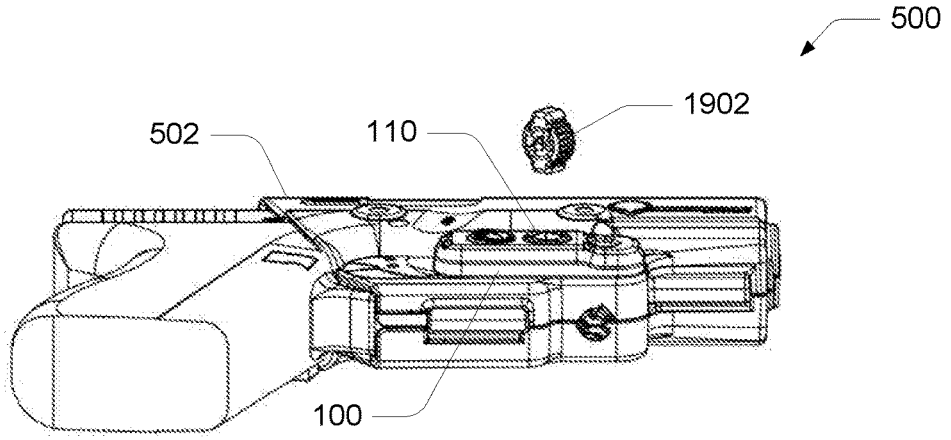
Figure 26:
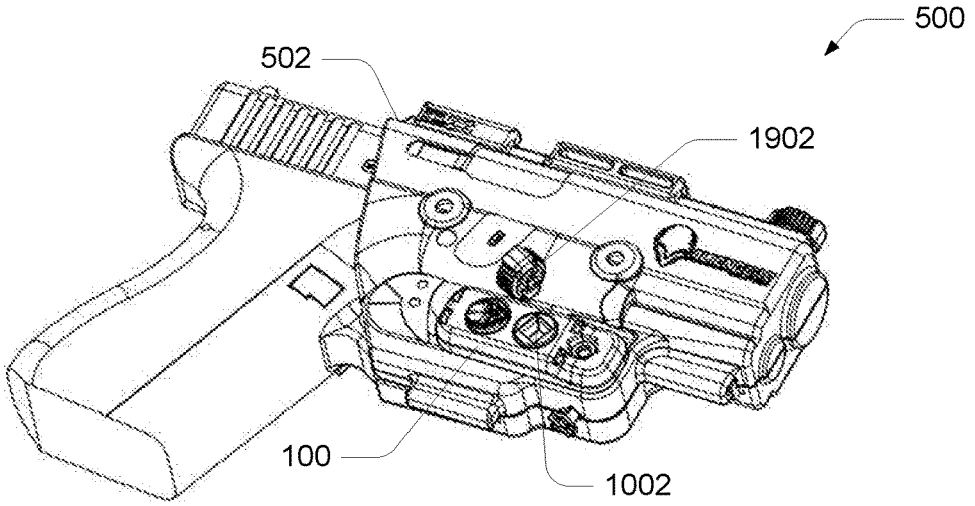
Figure 27:
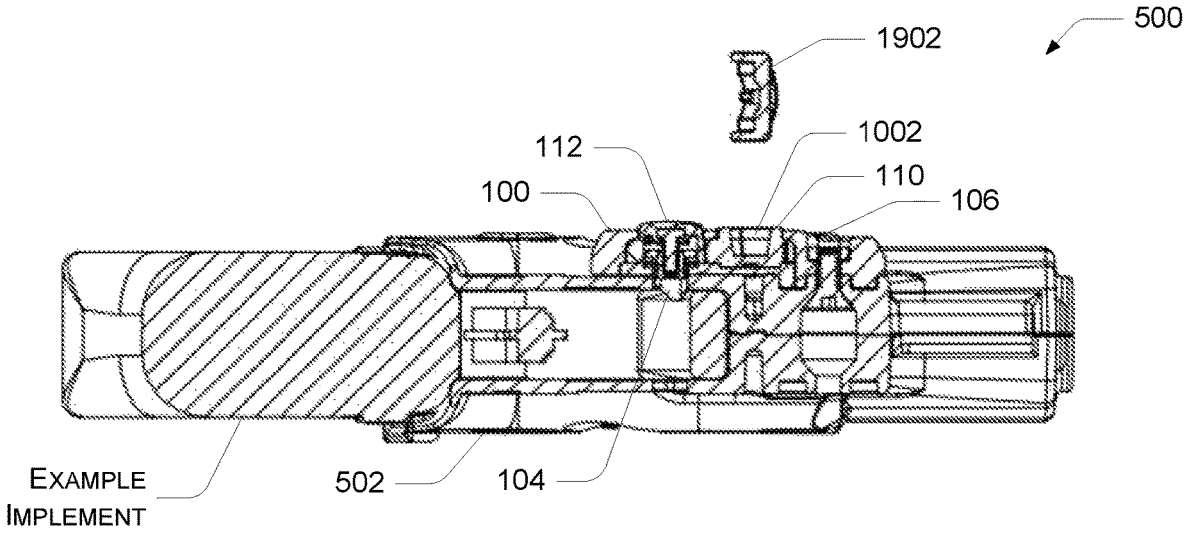
Figure 28:
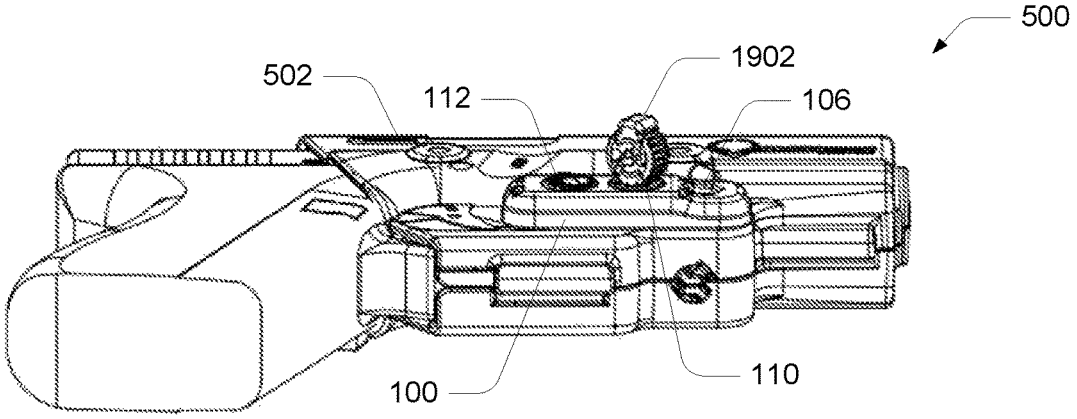

Referring to FIGS. 19-28, in various embodiments, the key 1902 is a component of the adjustable retention holster 500. For instance, in one example, the key 1902 comprises a locking device that may be used to lock coupled portions of the carrier 502 together. In such an example, the key 1902 may be removed from the carrier 502, as shown in FIG. 24, and may be placed into the feature 1002 of the adjustment screw 110, as shown in FIGS. 25-28, and used to turn the adjustment screw 110, as shown in FIG. 28. When the user is finished adjusting the retention of the device 100 and the holster 500, the key 1902 is replaced onto the carrier 502. Having the key 1902 be a component of the adjustable retention holster 500 means that the key (or tool) is always there when you need it. In alternate embodiments, the key 1902 (or other tool) may be stored elsewhere on the carrier 502, the retention device 100, or the like.

The retention device 100 is discussed in terms of determining and adjusting a retention of a holster, but the retention device 100 may also be used to determine and adjust a retention of various other cases, enclosures, and the like, where retention of the item is desired. Although various implementations and examples are discussed herein, further implementations and examples may be possible by combining the features and elements of individual implementations and examples.

In various implementations, components of the retention device 100 are comprised of various plastics, composites, metals, combinations of the same, or the like. For example, the base 102 and/or the bump 104 may be comprised of a polyamide, or similar material. For example, the retention device 100 components may be injection molded, stamped, formed, or the like. In various embodiments, the retention device 100 components have rigidity and stability properties based on a particular material selected for the retention device 100 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the retention device 100 components.

In various implementations, the retention device 100 may include fewer, more, or alternate components, and remain within the scope of the disclosure. In various embodiments, the shape and configuration of the retention device 100 components may vary to accommodate different implements or applications. In an example, the base 102 and/or bump 104 may be formed to closely fit a particular implement or carrier 502. In other examples, the base 102 and/or bump 104 may be more generally formed to fit multiple implements or carriers 502.

The illustrations of FIGS. 1-28 are not intended to be limiting. In the various example embodiments illustrated in FIGS. 1-28, the location and position of the components, mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a retention device 100 may be implemented as a stand-alone device or as part of another system (e.g., integrated with other components, such as with an adjustable retention holster 500, or the like). In various implementations, additional or alternative components may be used to accomplish the disclosed techniques and arrangements.

In various embodiments, the retention device 100, may be added to an existing arrangement (such as holsters and holster mounting apparatus and assemblies, for example). For instance, the existing arrangements may be retrofitted with the retention device 100 or with retention device 100 components. In other embodiments, the retention device 100 may be a part of a new arrangement, such as a new holster rig, case, enclosure, or the like.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. An adjustable retention holster, comprising:

an implement holster adapted to receive and to carry an implement, the holster including an opening in a side surface of the holster;

a first interchangeable retention device coupled to the holster, the first retention device comprising:

a base having a predetermined flexibility, the base adapted to resist bending with a predetermined amount of resistance when the implement is inserted or removed from the holster;

a mounting location disposed at a first end of the base and adapted to couple the first retention device to the holster; and a retention bump disposed at a second end of the base and adapted to protrude through the opening in the side surface of the holster, the retention bump arranged to contact the implement when the implement is inserted or removed from the holster, and to exert a bending force on the base when the implement is inserted or removed from the holster; and a second interchangeable retention device coupled to the holster, a retention bump of the second retention device protruding through a second opening in a surface of the holster, the combination of the first retention device and the second retention device determining an overall retention of the holster.

2. The adjustable retention holster of claim 1, wherein a predetermined flexibility of the second retention device is different from the predetermined flexibility of the first retention device.

3. The adjustable retention holster of claim 1, the first retention device further comprising one or more alignment nubs inserted into one or more corresponding recesses or openings in the holster and adapted to maintain a relative position of the first retention device to the holster while the first retention device is coupled to the holster.

4. An adjustable retention holster, comprising:

an implement holster adapted to receive and to carry an implement, the holster including an opening in a surface of the holster; and an interchangeable retention device coupled to the holster, the retention device comprising:

a base having a predetermined flexibility, the base adapted to resist bending with a predetermined amount of resistance when the implement is inserted or removed from the holster;

a mounting location disposed at a first end of the base and adapted to couple the retention device to the holster;

a retention bump disposed at a second end of the base and adapted to protrude through the opening in the surface of the holster, the retention bump arranged to contact the implement when the implement is inserted or removed from the holster, and to exert a bending force on the base when the implement is inserted or removed from the holster; and an adjustment screw moveably coupled to the base, wherein the retention bump is mechanically coupled to the adjustment screw and the retention bump is configured to move relative to the base, wherein a retention of the holster is user field-adjustable by rotating the adjustment screw.

5. The adjustable retention holster of claim 4, further comprising a key removably coupled to the holster and configured to fit into a feature of the adjustment screw and to rotate the adjustment screw, the key comprising a removable locking component of the holster.

6. The adjustable retention holster of claim 4, the retention device further comprising a gear-drive including the adjustment screw and an adjustment gear mechanically coupled to the adjustment screw, wherein the retention bump is mechanically coupled to the adjustment gear.

7. The adjustable retention holster of claim 6, wherein the retention bump is mechanically coupled to the adjustment gear via a screw component fixed to the adjustment gear and threaded into a screw hole of the retention bump.

8. The adjustable retention holster of claim 4, wherein the retention bump is configured to retract into the base when the adjustment screw is turned a first rotational direction and the retention bump is configured to extend from the base when the adjustment screw is turned a second rotational direction.

9. The adjustable retention holster of claim 1, wherein the retention bump traps a trigger guard of the implement when the implement is inserted into the holster.

10. The adjustable retention holster of claim 1, wherein a retention of the holster is user field-adjustable by interchanging the first retention device with another retention device having a base with a different predetermined flexibility.

11. The adjustable retention holster of claim 1, wherein the retention bump is adapted to resist an insertion and a removal of the implement from the holster, the retention bump having a ramped shape at a leading edge of the retention bump to define a lesser resistance to the insertion of the implement into the holster than a resistance to a removal of the implement from the holster.

12. The adjustable retention holster of claim 1, wherein the retention bump is adapted to resist an insertion and a removal of the implement from the holster, the retention bump including a blocked shape at a trailing edge of the retention bump to determine a greater resistance to the removal of the implement from the holster than a resistance to the insertion of the implement into the holster.

13. A retention device for an implement holster, comprising:

a base having a predetermined flexibility, the base adapted to resist bending with a predetermined amount of resistance when an implement is inserted or removed from the implement holster;

a mounting location disposed at a first end of the base and adapted to couple the retention device to the implement holster;

a retention bump disposed at a second end of the base and adapted to protrude through an opening in a surface of the holster when the retention device is coupled to the holster, the retention bump arranged to contact the implement when the implement is inserted or removed from the implement holster, and to exert a bending force on the base when the implement is inserted or removed from the implement holster; and an adjustment screw moveably coupled to the base, wherein the retention bump is mechanically coupled to the adjustment screw and the retention bump is moveably coupled to the base, the retention bump arranged to move relative to the base when the adjustment screw is rotated.

14. The retention device of claim 13, further comprising a ramped shape at a leading edge of the retention bump to define a lesser resistance to an insertion of the implement into the implement holster than a resistance to a removal of the implement from the implement holster.

15. The retention device of claim 13, wherein a retention of the implement holster is user field-adjustable by rotating the adjustment screw.

16. The retention device of claim 13, further comprising a gear-drive including the adjustment screw and an adjustment gear mechanically coupled to the adjustment screw, and wherein the retention bump is mechanically coupled to the adjustment gear.

17. The retention device of claim 16, wherein the retention bump is mechanically coupled to the adjustment gear via a screw component fixed to the adjustment gear and threaded into a screw hole of the retention bump.

18. The retention device of claim 13, wherein the retention bump is configured to retract into the base when the adjustment screw is rotated a first rotational direction and the retention bump is configured to extend from the base when the adjustment screw is rotated a second rotational direction.

19. A retention device for an implement holster, comprising:

a base having a first end and a second end;

a mounting location disposed at the first end of the base and adapted to couple the retention device to the implement holster;

an adjustment screw comprising a mechanical gear moveably coupled to the base, the adjustment screw configured to adjust a retention value of the retention device;

an adjustment gear mechanically coupled to the adjustment screw; and a retention bump movably disposed at the second end of the base and mechanically coupled to the adjustment gear via a screw device, the retention bump adapted to protrude through an opening in a surface of the implement holster when the retention device is coupled to the implement holster and to contact the implement when the implement is inserted or removed from the implement holster, and to exert a force on the base when the implement is inserted or removed from the implement holster to retain the implement within the implement holster.

* * * * *